United States Patent [19]

Westerman et al.

[11] 4,374,544

[45] Feb. 22, 1983

[54] TECHNIQUE FOR CONTROL OF INJECTION WELLS

[75] Inventors: Granval W. Westerman, Midland, Tex.; Corbett I. Otwell, Hobbs, N. Mex.

[73] Assignee: Standard Oil Company (Indiana), Chicago, Ill.

[21] Appl. No.: 188,631

[22] Filed: Sep. 19, 1980

[51] Int. Cl.[3] ..... E21B 43/16

[52] U.S. Cl. ..... 166/252

[58] Field of Search ..... 166/252, 66, 53, 370

[56] References Cited

U.S. PATENT DOCUMENTS 4,149,598 4/1979 Christian ..... 166/370

4,150,721 4/1979 Norwood ..... 166/66

4,185,691 1/1980 Tubin ..... 106/53

4,215,746 8/1980 Hallden ..... 166/66

*Primary Examiner*—William F. Pate, III

*Attorney, Agent, or Firm*—William E. Murray; Stephen R. May; John D. Gassett

[57] ABSTRACT

An injection well control method and apparatus controls fluid injection rates during secondary or tertiary petroleum recovery operations by monitoring bottomhole pressure adjacent an underground formation receiving the injected fluids while simultaneously adjusting the fluid injection rate to substantially reduce unwanted variations in said bottomhole pressure. The injection controller is further adapted for operation on a solar-powered circuit to eliminate the need for electrical power lines in remote geographical locations.

5 Claims, 7 Drawing Figures

TECHNIQUE FOR CONTROL OF INJECTION WELLS

BACKGROUND OF THE INVENTION

1. Field of the Invention

This invention relates to a control technique for the injection of fluids into a subterranean formation to increase the production of hydrocarbons during a secondary or tertiary oil recovery process. During a secondary or tertiary oil recovery process, many injection wells are controlled by monitoring the surface pressure, and then maintaining said pressure below the parting, i.e., fracturing, pressure of the formation receiving the injected fluids. However, many injection wells do not exhibit a discernible surface pressure, and thus cannot be controlled in this manner. Other injection controllers have maintained a constant mass flow rate of fluid into the subterranean formation regardless of the pressure variations occurring during fluid injection. U.S. Pat. No. 3,455,382 entitled "Injection Flow Control Apparatus for Wells", and issued to D. V. Chenoweth on July 15, 1969, describes an injection well controller of this type.

None of the previous control techniques teach measuring the pressure at the face of the zone receiving the fluid during injection while using such measured pressures to maintain the bottomhole pressure relatively constant during the injection of said fluids.

SUMMARY OF THE INVENTION

This is a method and apparatus for controlling the injection of fluid into an underground formation which continually measures the bottomhole pressure adjacent said underground formation during injection of said fluid and maintains the rate of injection so that the bottomhole pressure does not exceed a selected pressure or stays within a preset range. In a preferred embodiment means are provided to maintain both the rate of injection and the measured downhole pressure within preset ranges. This control technique allows optimization of injection rates, thereby increasing the recovery of hydrocarbons during a secondary or tertiary recovery process. It also prevents fracturing the formation by injecting fluid at a pressure above the formation parting pressure. If the injection fluid fractures the formation, the effectiveness of the recovery process is greatly reduced and more oil is left unrecovered.

DETAILED DESCRIPTION OF THE INVENTION

The apparatus and method of the instant invention have been adapted to operate on a solar energy-battery powered system, thus eliminating the need to run cables for electrical power to the relatively isolated geographical locations where injection wells are often found. The resulting cost savings of the use of such a solar powered system increases the advantage of the use of the instant invention.

Figure 1:
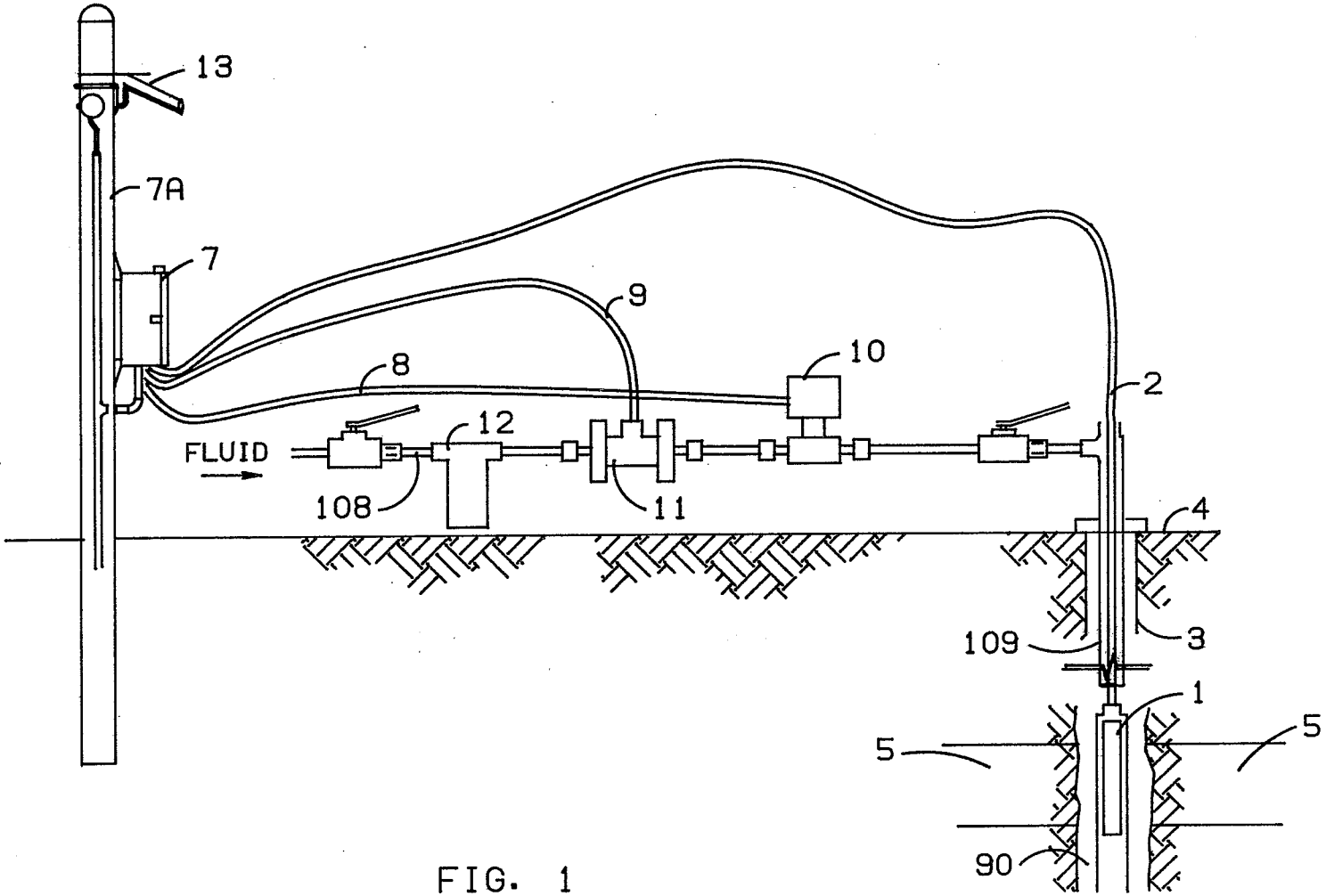
FIG. 1 is a schematic view showing a preferred embodiment of the apparatus of the instant invention installed at a well site.

Referring now to FIG. 1, therein depicted is a schematic drawing of a preferred embodiment of the control apparatus of the instant invention. A combined bottomhole pressure detector and transmitter 1 is placed in wellbore 90 through tubing 109 and wellhead casing 3 below the earth's surface 4 so that it is adjacent zone 5 into which fluid is injected. The pressure transmitter's output signal is sent via cable 2 to injection controller 7 which is mounted on post 7A. As will be explained below, controller 7 has an output control signal used to regulate the rate of flow of injection fluid.

The bottomhole pressure is measured downhole by the pressure detector preferably utilizing a strain gauge pressure transducer and is sent through cable 2 to the injection controller 7 to be used for the regulation of the fluid injection rate. The injection controller is also connected to a turbine meter 11 which measures the injection rate of fluids into the well. The output control signal of the injection controller is connected to control valve 10 through line 8 to regulate the rate of flow of the injection fluid. The control valve 10 is the means used to regulate the flow of fluids through the flow line down into the subterranean formation 5.

In the method of the instant invention, fluid from a source (not shown) is injected through a filter 12 in flow line 108, through a turbine meter 11 where the flow rate is monitored, through the control valve 10, and then down tubing 109 into the subterranean formation 5. In the method of the instant invention the bottomhole pressure in the vicinity of zone 5 is detected during injection of said fluid and the detected pressure is transmitted to the injection controller 7. The injection controller is powered by the solar panel 13, mounted on a post 7A above the injection controller. The injection controller uses the measured pressure and injection rate to determine the needed regulation of the flow of fluids into the well.

Figure 2:
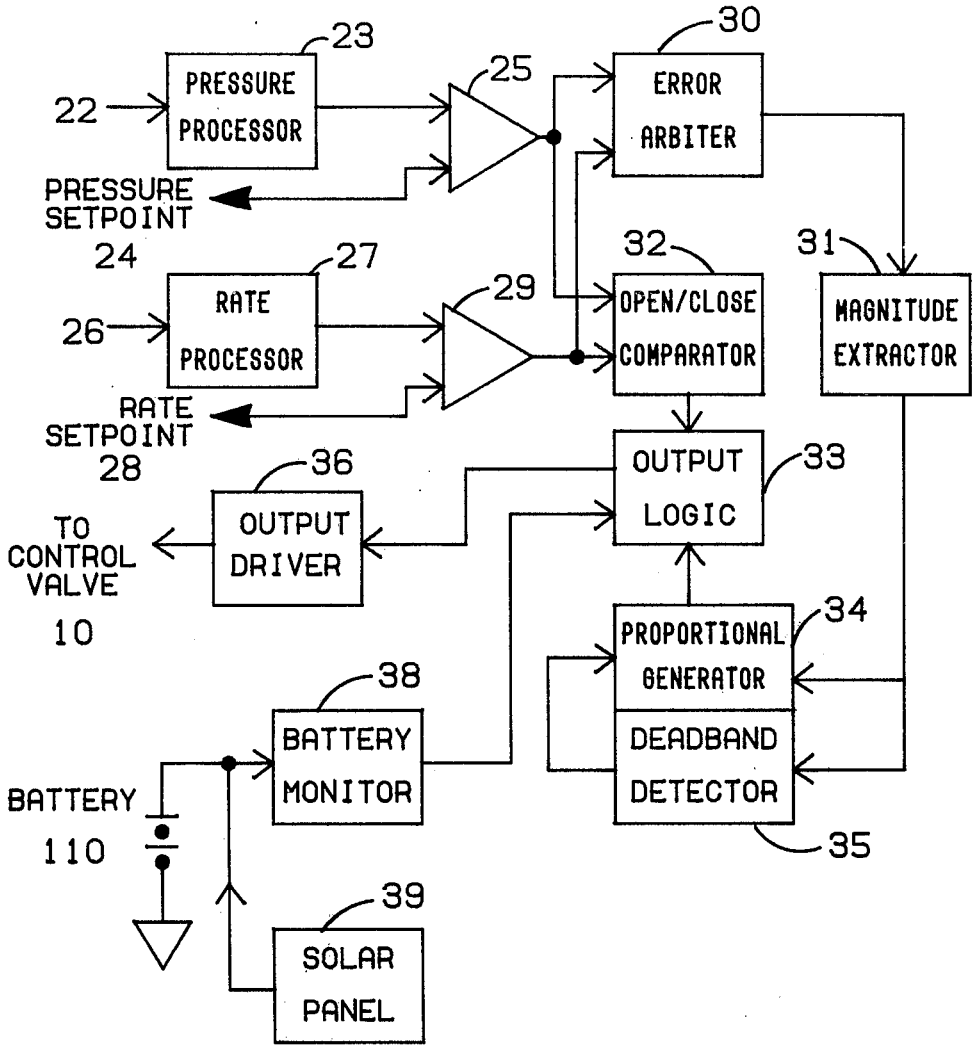
FIG. 2 is a block diagram of the injection control system.

FIG. 2 shows a block diagram of how one embodiment of the control system inside the injection controller 7 functions. Control systems other than the specific one shown in FIG. 2 can be used but it is considered that the system shown is preferred. A suitable commercially available controller is the 300 CD Solar Powered Set Point Controller manufactured by End Devices, Inc., Box 522, Midland, Tex. 79701.

A signal 22 representing the bottomhole pressure measured by the bottomhole pressure sensor is transmitted to a pressure processor 23 which places the signal in a form compatible with the internal circuits of the controller 7. The output of pressure processor 23 is transmitted to a pressure subtracter 25. The pressure subtracter 25 compares the measured bottomhole pressure to a preset pressure value 24. The pressure subtracter 25 then determines the difference between the actual bottomhole pressure and the preset pressure value and transmits that difference to the error arbiter 30. Error arbiter 30 will be explained in connection with FIG. 3.

At the same time as the bottomhole pressure is transmitted to the injection controller, the injection rate 26 is also measured and transmitted through line 9 (as depicted in FIG. 1) to the injection controller 7. The rate is sent to a rate processor 27 which converts the rate signal into a form suitable for use as an input signal rate subtracter 29. The rate subtracter compares the injection rate to a preset rate from set point 28. The rate subtracter then determines the difference between the actual injection rate and the preset rate and sends that difference to the error arbiter 30. The difference between the pressure rate and the preset pressure rate as determined by the pressure subtracter 25 is also sent to the open/close comparator 32 which will be described in connection with FIG. 4. In a like manner, the difference between the injection rate and the preset rate as determined by the rate subtracter 29 is also sent to the open/close comparator 32.

The error arbiter 30 determines which of the calculated differences, either the pressure difference from subtracter 25 or the injection rate difference from subtracter 29, has the larger positive value. The arbiter 30 then sends this higher calculated difference, the control error, to the magnitude extractor 31 which will be discussed further in relation to FIG. 5. The magnitude extractor 31 determines the magnitude of the calculated difference (i.e., control error) electrically and sends that information to the proportional generator 34 and the dead band detector 35, both of which will be discussed later in connection with FIG. 6.

The dead band detector 35 determines if the magnitude of the control error as calculated by the magnitude extractor 31 is greater than a selected percent, e.g., 1% of the preset values from set points 24 and 28. If the magnitude of the control error is not greater than a selected percent of the preset value, the dead band detector 35 does not send a signal to the proportional generator 34. This maintains the position of the control valve 10 at its previously determined position.

Unless inhibited by the dead band detector 35, the proportional generator 34 receives the control error signal and produces an electrical signal proportional to the change required to regulate the control valve in response to the magnitude of the error signal so that the control valve will be opened or closed in proportion to the desired change in injection rate. The proportional generator 34 sends this generated signal to the output logic 33.

The open/close comparator 32 takes the pressure and injection rate errors as calculated by the pressure subtracter 25 and the rate subtracter 29, respectively, and compares them to the current control valve setting and determines whether the control valve 10 needs to be opened or closed. The open/close comparator 32 then sends this information to the output logic.

The output logic 33 receives the information from the open/close comparator 32 and the proportional generator 34 and sends a control signal to an output driver 36 which transmits the control instructions to the control valve 10 to open or close a directed amount, or to remain in the same position.

The entire injection controller is preferably powered by a solar panel 39 which is connected to battery 110 and battery monitor 38. The solar panel maintains the charge on the battery at an operative level. If the battery monitor shows that the power as supplied by the solar panel and battery is insufficient to allow the functioning of the system, the battery monitor sends a response to the output logic 33 which prevents any change in the then-current operating position of control valve 10.

Figure 3:
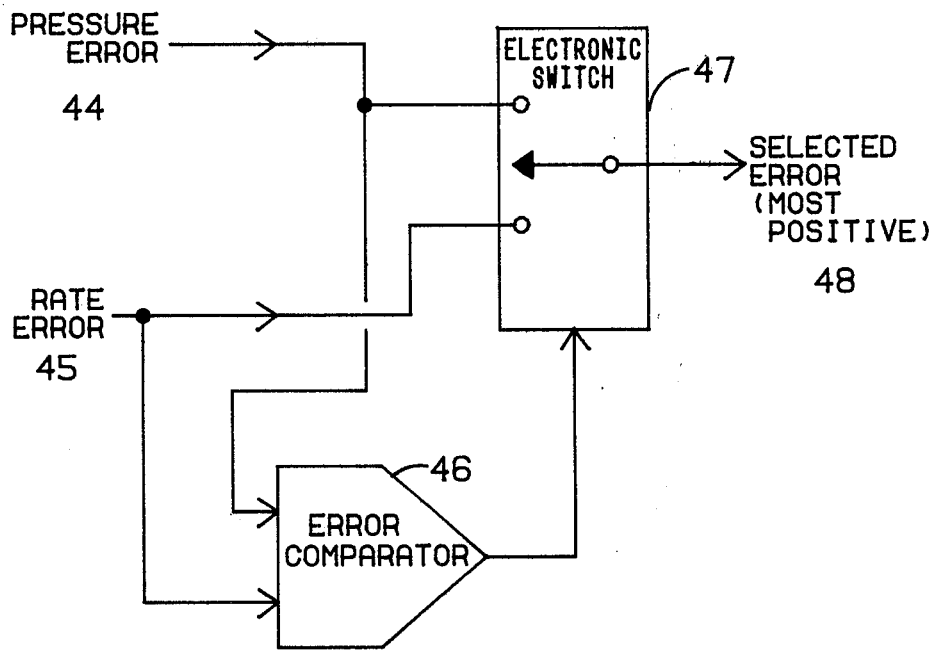
FIG. 3 shows a schematic of the error arbiter indicated in FIG. 2 for selection of a control error used in the control technique.

Some of the component parts of the schematic block diagram of FIG. 2 will now be examined in more detail. It is considered that the other component parts need no further explanation to those skilled in the control systems art area. FIG. 3 shows a schematic diagram of the error arbiter 30. The arbiter receives the pressure error signal 44 from subtracter 25 and the rate error signal 45 from subtracter 29 and sends them to an error comparator 46 which determines which of the errors is the more positive. The pressure error and rate error signals are also transmitted to electronic switch 47. The output signal from the error comparator is also transmitted to electronic switch 47. The error comparator's output signal tells the switch which of the pressure or rate error signals is the more positive. The switch then transmits the selected more positive error to the magnitude extractor 31 as the control error 48.

Figure 4:
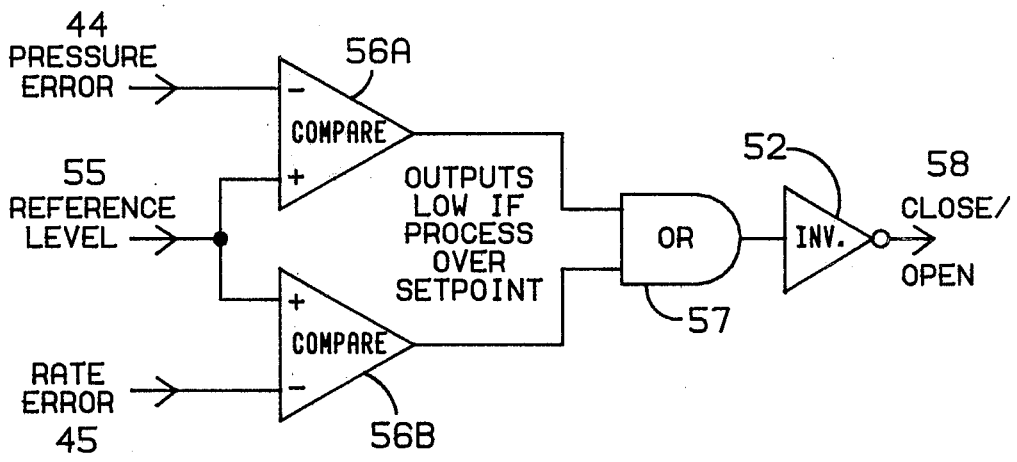
FIG. 4 shows a schematic of the open/close comparator indicated in FIG. 2 which determines whether the control valve in the fluid flow line requires opening or closing.

FIG. 4 shows a schematic diagram of the functioning of the open/close comparator 32. The pressure error 44 and the flow rate error 45 are fed into comparators 56A and 56B, respectively. The comparators compare the pressure error and rate error to a reference level 55 for each, and determine if the pressure and rate error are above or below their reference set point. If either comparator 56A or 56B, or both has a flow line output signifying either too high bottom hole pressure or too high a flow rate, then OR gate 57 has a positive output which is sent to inverter 52. If the inverter has a zero pulse, this directs the output logic 33 to close the control valve 10. If the inverter has a positive pulse, it directs logic curcuit 33 to open the control valve 10. Thus the output signal of the comparator communicates whether the valve 10 should be opened or closed. The signal from proportional generator 34 determines the extent the valve is opened or closed.

Figure 5:
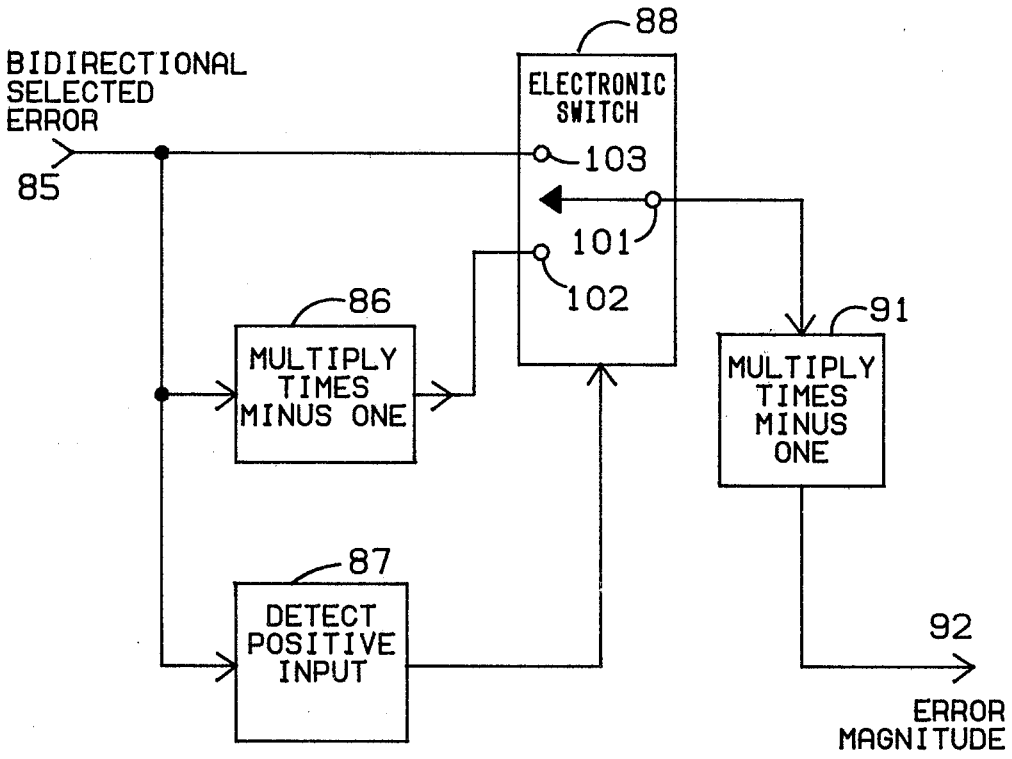
FIG. 5 shows a schematic of a system indicated in FIG. 2 which determines the magnitude of the control error.

FIG. 5 shows a schematic of the functioning of the magnitude extractor 31. The control error 85 as selected by the error arbiter 30 is the input signal for the magnitude extractor. The control error signal 85 is transmitted to an electrical switch 88 and also to a multiplying circuit 86. The multiplying circuit multiplies the control error by $-1$. The control error also goes to a circuit 87 which detects if the control error 85 is a positive input. The output of circuit 87 is also transmitted to the electronic switch 88. The output of the multiplier circuit 86 is the third input for the electronic switch 88. The output from the "detect positive input" circuit 87 directs internal switch 101 to connect with terminal 102 or 103. If there is a positive input to 87, switch 101 connects with terminal 102. If there is no positive input to 87, then internal switch 101 connects with terminal 103. This assures that the output of switch 88 is always negative. This negative signal is transmitted to circuit 91 which multiplies the value of the output from switch 88 by $-1$. As there are two negative values, the output 92 from circuit 91 is always positive and has a magnitude of the error 85. The output 92 is then communicated to the proportional generator 34 and dead band detector 35.

Figure 6:
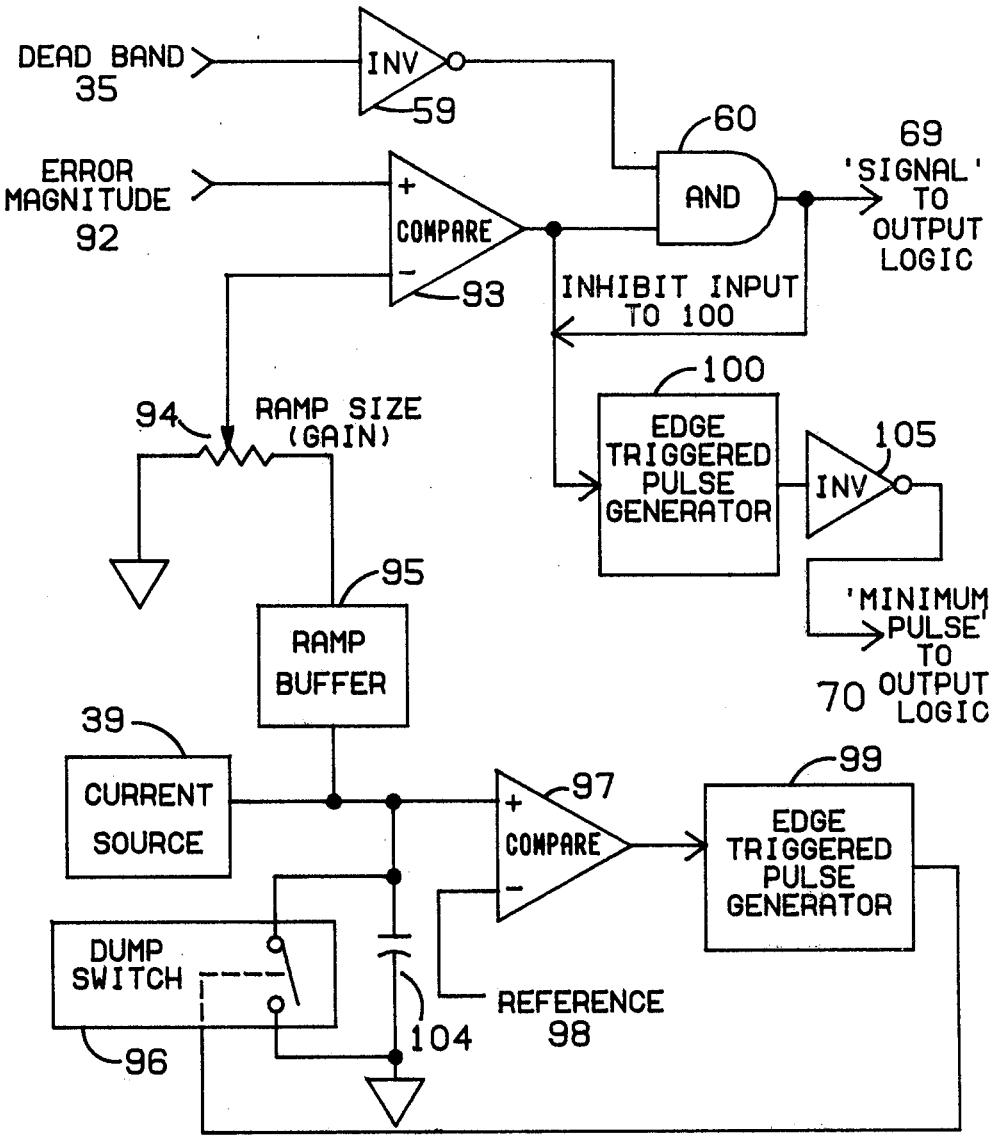
FIG. 6 shows a schematic of a proportional generator indicated in FIG. 2 which creates a control signal to operate the control valve.

FIG. 6 shows a schematic of the proportional generator (34 in FIG. 2) used to generate and transmit a control signal having an electrical pulse of a width or time duration in proportion to the magnitude of the control error 92. This control signal ultimately controls the opening size of valve 10. A suitable proportional generator is set forth in FIG. 6 although others could be used. The proportional generator receives the electrical signals from the magnitude extractor 31 and the dead band detector 35. As stated above, the dead band detector only determines if the control error magnitude 92 as determined by the magnitude extractor 31 is greater than a selected percent (e.g., 1% of a preset value). Dead band detector 35 thus has an output only if the magnitude of the control error as determined by extractor 31 is less than a certain percentage of the preset value. The input from the dead band detector 35 goes through an inverter circuit 59 and from there into one input of AND gate 60.

Comparator circuit 93 sends its output to the other input of the AND gate 60. If there is any input at all from the dead band circuit 35, AND gate 60 is thus activated, and sends a signal 69 to output logic 33. Signal 69 inhibits the output logic circuit thereby maintaining control valve 10 at its then-current position. Signal 69 also inhibits the input from comparator 93 to the edge triggered pulse generator 100 and prevents the generation of a minimum pulse 70.

The solar panel-battery current source 39 generates a constant current which builds a charge on capacitor 104. The comparator 97 compares the voltage on the capacitor to a reference voltage 98. A suitable comparator circuit such as 93 and 97 is commercially available from Motorola, Inc. and is identified as MLM 358. When the capacitor voltage exceeds the reference voltage, comparator 97 produces a high output to edge triggered pulse generator 99. A suitable generator for 99 and 100 is commercially available from RCA, Inc. and is identified as a CD 40 98 BE. The pulse generator generates a sawtooth signal of known configuration, which is sent to dump switch 96. When the generated signal reaches the switch, the switch is closed and the capacitor is discharged. The capacitor voltage then continuously varies from zero up to the reference voltage. The capacitor output voltage is sent to ramp buffer 95 which isolates the upper circuit from the lower voltage generating circuit. The output voltage is next transmitted to the ramp size gain potentiometer 94.

Comparator 93 receives the voltage from ramp size gain potentiometer 94 and compares it to the error magnitude 92 determined by the magnitude extractor (as indicated in FIG. 5). The comparator's output is high when the voltage from ramp size gain potentiometer 94 decreases to zero as the capacitor 104 is discharged. The comparator's output is low when the error magnitude 92 is less than the voltage from the ramp size gain potentiometer. The net effect is that a signal proportional to the error magnitude is sent to edge triggered pulse generator 100.

Edge triggered pulse generator 100 accepts the proportional impulse signal from comparator 93 (unless the output from the comparator is blocked by the dead band detector 35) and generates a pulse 70 of a minimum width required to operate control valve 10. The minimum width pulse 70 is inverted in inverter circuit 105, and it is then transmitted to the output logic 33. The minimum width pulse 70 then is proportional to the control error 85 and informs the output logic how much correction is needed in the position of control valve 10.

Figure 7:
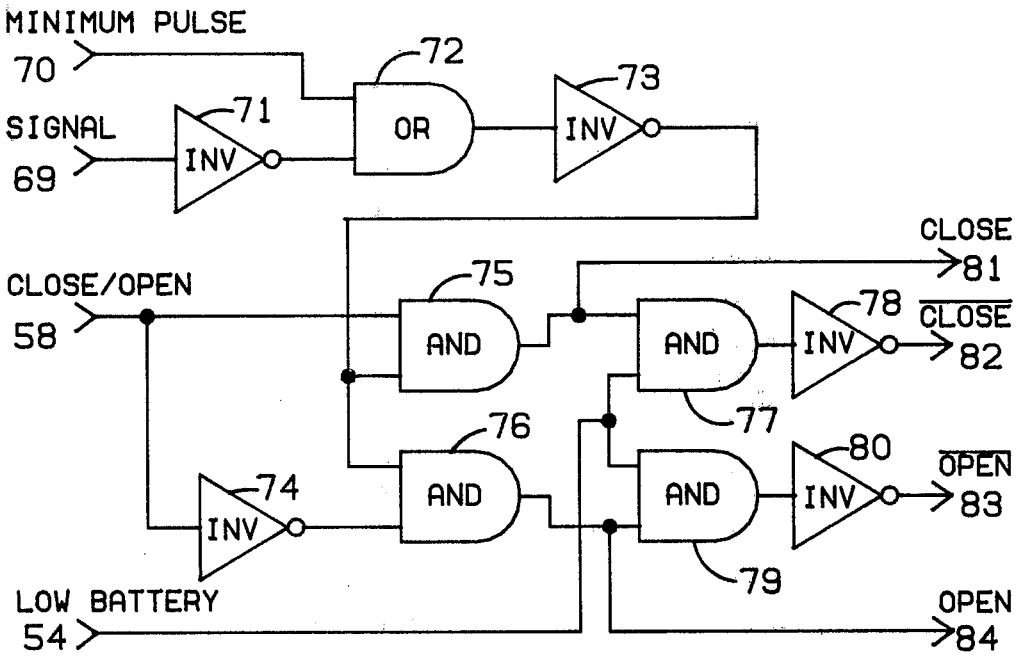
FIG. 7 shows a logic output indicated in FIG. 2 used to regulate the control of fluid injection.

The output logic circuit 33 uses the minimum width pulse 70 as determined by the proportional generator 34 as one input as is shown in greater detail in FIG. 7. Another input connection to the output logic circuit is the signal from the dead band detector 35 should it activate its AND circuit 60. An additional input is the open/close comparator signal 58 from the open/close comparator 32. The minimum width pulse signal and the signal 69 from the dead band detector 35 are combined in an OR circuit 72 after the signal from the dead band detector is inverted in an inverting circuit 71. The signal leaving the OR circuit 72 is injected into another inverting circuit 73. From there it goes to AND gate 75 together with the open/close comparator signal. The open/close comparator signal is also sent to inverting circuit 74 and from there to another AND gate 76 which receives its other input from inverter 73.

If the signal from inverter 73 (from dead band detector 35) is negative, it inhibits AND gates 75 and 76. This prevents any signals or output from terminals 81, 82, 83 and 84. Thus, the valve 10 stays in an unchanged position. If the signal from inverter 73 is positive, AND gates 75 and 76 have an output upon receiving a signal 58. Signal 58 is fed to one input of AND gate 75 and after being inverted by inverter 74 is fed to the other input of AND gate 76. Thus, only one of AND gates 75 and 76 has a non-zero output at any one time.

There are two sets of terminals shown, a first set 81 (closed) and 82 (not closed) and a second set 83 (not open) and 84 (open) but only two terminals are used at any one time—one terminal from each set. Assume terminals 81 and 84 are selected in "close" signal 58 (together with the signal from inverter 73) which activates AND gate 75 but not AND gate 76. Thus in this case there is a control signal on terminal 81. If there is an "open" signal 58 (negative), AND gate 75 is inhibited and AND gate 76 has an output signal which appears on terminal 84 to control the opening of valve 10 to the new control position. If terminals 82 and 83 are selected to have an output, there must be a positive signal from battery 54 indicating that the battery is sufficiently charged. Terminals 82 and 83 control relays which, if the battery becomes discharged, will disable the signals on terminals 81 and 84 and "freeze" valve 10 in its then-current position.

The apparatus and method of the preferred embodiment were tested commencing in November 1979 in an injection well for a waterflood in the North Cowden Field in Texas. The injection control unit was set to maintain a bottomhole pressure of 1850 psi during fluid injection. For a four-month period from December 1979 through March 1980 the controller maintained a bottomhole pressure at an average 1843 psi with an average fluid injection rate of 520 bbl/d.

It should be readily apparent to one skilled in the art that this invention is not limited to the embodiments described herein. Rather, the scope of our invention is defined by the appended claims.

We claim:

1. A method of controlling the injection of a fluid through a wellbore into an underground formation which comprises:

(a) injecting said fluid through said wellbore into said formation;

(b) detecting the pressure of said fluid in said wellbore in the vicinity of said formation; and (c) using the pressure detected in step (b) to control the rate of injection of said fluid such that the pressure in the wellbore in the vicinity of said formation is maintained within a predetermined range.

2. A method for controlling the rate of injection of fluid into an underground formation comprising:

(a) measuring both the injection rate of fluid into the underground formation and the bottomhole pressure adjacent said formation during the injection of fluid into the underground formation;

(b) calculating the difference between each of said measured quantities and a preset value for each;

(c) comparing the differences calculated in step (b) to determine a control error which is the calculated difference with the larger deviation from its respective preset value;

(d) generating a control signal proportional to said control error;

(e) transmitting said control signal to an injection control valve in the flow line between the injection pump and the injection well; and (f) operating said valve in response to said control signal to maintain the injection of fluid within a desired range.

3. A method for controlling the rate of injection of fluid into an underground formation comprising:

(a) monitoring both the rate of injection of fluids into said well and the bottomhole pressure in said well in the vicinity of said formation;

(b) comparing the value of said injection rate and said bottomhole pressure to a preset value for each;

(c) operating an injection control valve in response to the comparison made in step (b) so that the valve controls the rate of fluid injection to maintain both the bottomhole pressure and the injection rate near their respective preset values such that the bottomhole pressure in the well in the vicinity of said formation is maintained within a predetermined range.

4. Apparatus for controlling the rate of fluid injection into an underground zone comprising:

(a) measuring means for both the injection rate and the bottomhole pressure in a wellbore adjacent the zone receiving the fluid during said fluid injection;

(b) control error determining means for selecting a control error which is the larger deviation from a preset value of either the bottomhole pressure or injection rate measured by said measuring means;

(c) signal generating means for generation of an electrical signal proportional to the control error determined by said control error determining means;

(d) control means for regulating the rate of fluid injection into said underground formation; and (e) signal transmitting means for communicating the signal generated by said signal generating means to said control means.

5. A system for controlling the injection rate of a fluid through a wellbore into an underground zone which comprises:

(a) means for injecting said fluid through said wellbore into said zone;

(b) pressure monitoring means for detecting the pressure of said fluid in said wellbore at the level of said underground zone; and (c) means for controlling the rate of flow of said fluid in response to the pressure detected by said pressure monitoring means such that the bottomhole pressure in the wellbore in the vicinity of said formation is maintained within a predetermined range.

* * * * *